US005435609A

United States Patent [19]

Igata et al.

[11] Patent Number: 5,435,609

[45] Date of Patent: Jul. 25, 1995

[54] ANTI-THEFT APPARATUS FOR VEHICLE DOOR LOCKS

[76] Inventors: Tetzuzo Igata, 906 Hamilton Dr., Greenberg, Ind. 47240; Yoshimasa Ishiguro, 43207 Still Creek Cir., Novi, Mich. 48375; Norman Kerr, III, 728 Watersedge, Ann Arbor, Mich. 48105-2517

[21] Appl. No.: 127,739

[22] Filed: Sep. 28, 1993

[51] Int. Cl.[6] ..... E05B 17/00

[52] U.S. Cl. ..... 292/346; 292/307 B; 292/337; 292/DIG. 73

[58] Field of Search ..... 292/307 B, 307 R, 337, 292/346, DIG. 53, DIG. 54, DIG. 73; 74/608; 70/416, 418

[56] References Cited

U.S. PATENT DOCUMENTS

| | | | |
|---|---|---|---|
| 1,397,917 | 11/1921 | Behrman | 292/307 R |
| 1,821,145 | 9/1931 | Dion | 292/307 B |
| 3,067,630 | 12/1962 | Hartman | 74/608 |
| 3,333,439 | 8/1967 | Bessette | 292/307 R X |
| 4,508,379 | 4/1985 | Mochida | 292/346 X |
| 4,902,058 | 2/1990 | Ohhashi et al. | 292/346 X |
| 5,036,161 | 7/1991 | Sachs | 292/307 R X |

*Primary Examiner*—Rodney M. Lindsey
*Attorney, Agent, or Firm*—Browdy and Neimark

[57] ABSTRACT

An improved anti-theft device for use with a vehicle door locking mechanism, the latter having a sill knob rod rotatably connected to a locking lever so that actuating the sill knob rod moves the locking lever to either lock or unlock the locking device, includes a housing to cover and protect the locking mechanism. The tube is joined to the housing and surrounds the sill knob rod engaged to the locking lever. The periphery of the sill knob rod is spaced away from the inner wall of the tube over the full length of the sill knob rod enclosed within the tube.

12 Claims, 4 Drawing Sheets

F
B
1
E
A
G
H
2
4
C

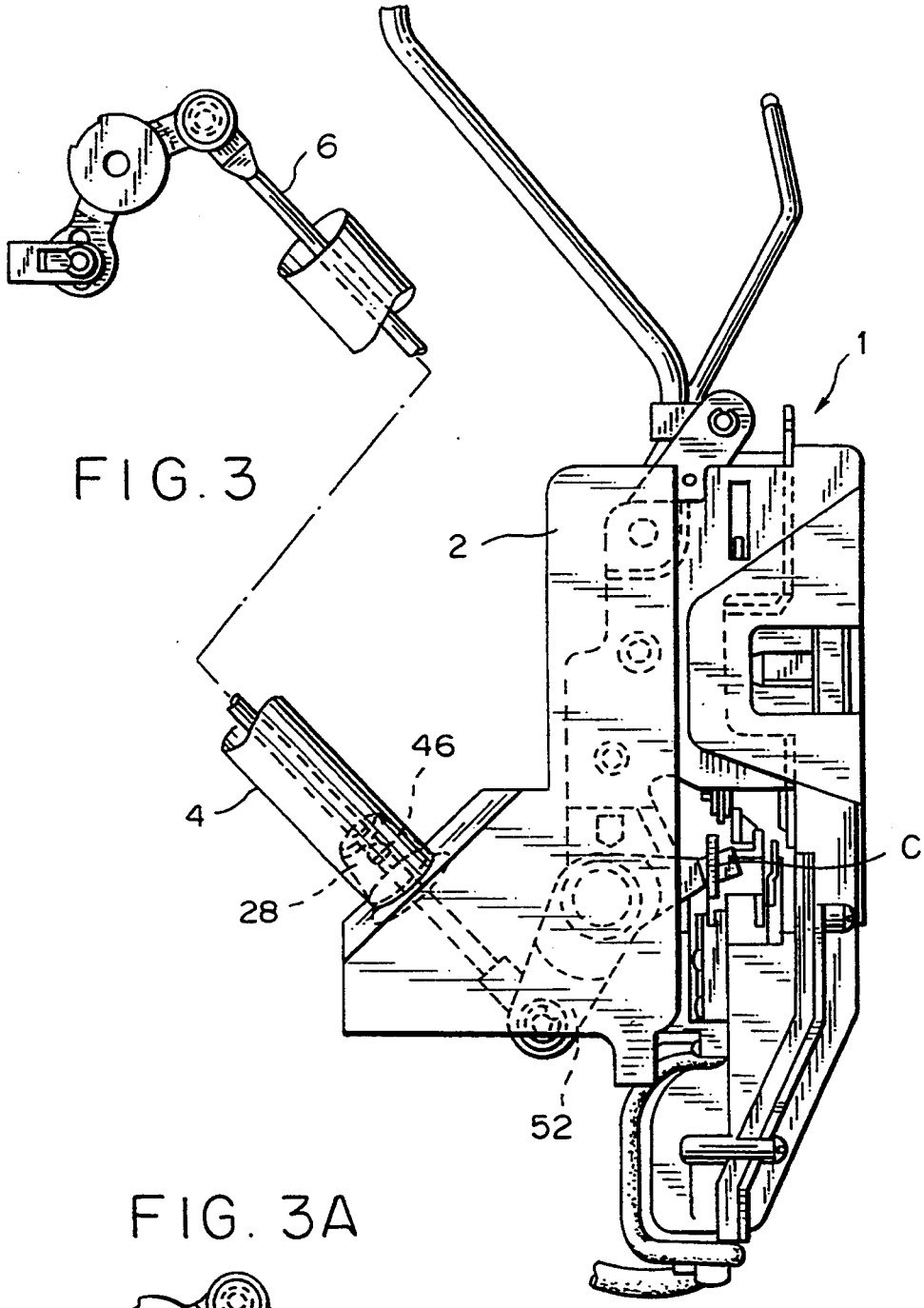
FIG. 3
FIG. 3A
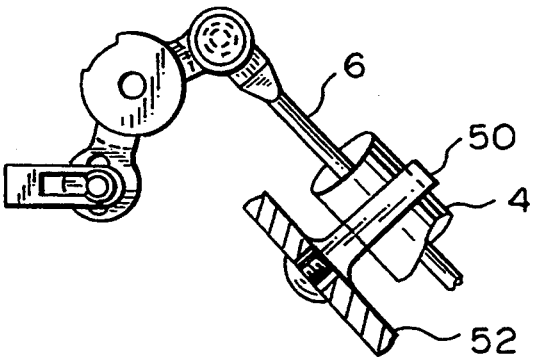

ANTI-THEFT APPARATUS FOR VEHICLE DOOR LOCKS

FIELD OF THE INVENTION

The present invention relates to an improved anti-theft device for a vehicle door lock and latch mechanism.

BACKGROUND OF THE INVENTION

As shown in FIG. 1, a conventional locking and latching mechanism for vehicle doors has an opening lever which can be moved vertically by a door handle (not shown). The door handle is connected to opening lever A by an opening rod B. The locking mechanism further has an interlocking lever (not shown) engaged to release or lock a ratchet (not shown) which can be engaged to a strike plate mounted to the vehicle body. The locking mechanism further has a locking lever C rotatably mounted on an output shaft D on a base plate E. A sill knob rod J having a sill knob (not shown) at its upper end is connected at its lower end to a first arm of the locking lever C. The opening lever A is rotatably engaged to a second arm of locking lever C.

When the locking lever C is turned by either actuating sill knob rod J or key rod F, the locking lever C is switched from an unlocked position in which a projection G on the opening lever A is moved to be opposite a pin H on the interlocking member, or to a locked position in which projection G of the opening lever A is moved to be spaced apart from pin H of the interlocking member. Thus, when the locking lever C is in the unlocked position, actuating the door handle will cause projection G to engage pin H and move the pin H to thereby disengage the ratchet from the strike plate and permit the door to be opened. When, however, the locking lever is in the locked position, actuating the door handle will not engage spaced apart projection G and pin H, thereby leaving the ratchet engaged and the door closed, in "locked" position.

In earlier prior art locking and latching of this general type, thieves were able to grip sill knob rod J with a gripping tool forced through the gap between the lower edge of a closed window above the locking mechanism and the adjacent edge of the corresponding vehicle door panel, and were thus able to move the rod J and thereby move locking lever C from a locked to an unlocked position. In order to deter such activity prior art locking devices have been provided as shown in FIG. 1 with an anti-theft tube I which surrounds the upper portion of sill knob rod J so as to make access to the rod more difficult, i.e. the anti-theft tube I inhibits and often prevents grasping of the rod J by the gripping tool used by car thieves.

As shown in FIG. 1, bend points are provided on sill knob rod J to align the sill knob rod within the anti-theft tube I and deter it from rattling within the tube. A washer L is further provided to maintain the lower portion of sill knob rod J coaxially aligned within the tube I. In addition, stops M are provided to inhibit relative axial movement of the tube I on the sill knob rod J.

While the prior art anti-theft tube has been a proven deterrent to theft, it has a number of disadvantages, most important of which is the fact that thieves have continued to use the gap between the closed window and door to insert tools able to grip the portion of the sill knob rod J exposed below the anti-theft tube I to unlock the locking lever. In addition, notwithstanding the use of the bends in the sill knob rod J and the alignment washer L with stops M, relative movement of the anti-theft tube I on the rod J still occurs causing rattling which greatly irritates vehicle passengers. Further, under certain circumstances the tube I can become caught against the interior of the vehicle door panel, resulting in friction between the sill knob rod J and the tube I when the sill knob is actuated; this in turn makes it difficult to unlock the door using the sill knob, which is annoying and disconcerting to the user.

SUMMARY OF THE INVENTION

Accordingly, it is an object of the present invention to overcome deficiencies in the prior art, such as indicated above.

It is a further object to provide an improved anti-theft device for vehicle door locks which eliminates the above identified problems of the prior art. This is accomplished by creating an improved anti-theft device which precludes the previous access thieves have had to the lower portion of the sill knob rod and which also eliminates the rattles and friction associated with the prior art devices.

Yet another object of the present invention is to provide an anti-theft tube which is directly joined to the housing of the locking device so as to preclude access to the lower portion of the sill knob rod.

Still a further object of the present invention is to arrange the sill knob rod and the improved anti-theft tube to be coaxial and spaced apart to obviate rattles and friction between the sill knob rod and the tube.

Still another object of the present invention is to fix the free end of the improved anti-theft tube to the inner wall of the vehicle door panel to further stabilize the tube and avoid rattles between the sill knob rod, the tube or the door panel.

Yet a further object of the present invention is to produce an improved anti-theft device for use with vehicle door locking mechanisms which can be manufactured at a lower cost than the prior art devices.

Other objectives of the present invention will become apparent from the detailed description of the preferred embodiments found below with reference to the accompanying drawings described hereafter.

BRIEF DESCRIPTION OF THE DRAWINGS

FIG. 3 is an exploded side elevation of the locking and latching mechanism and anti-theft device FIG. 2.

FIG. 3A is a partial side elevation of another embodiment of the locking and latching mechanism and anti-theft device of FIG. 3.

DETAILED DESCRIPTION OF THE PREFERRED EMBODIMENT(S)

Figure 1:
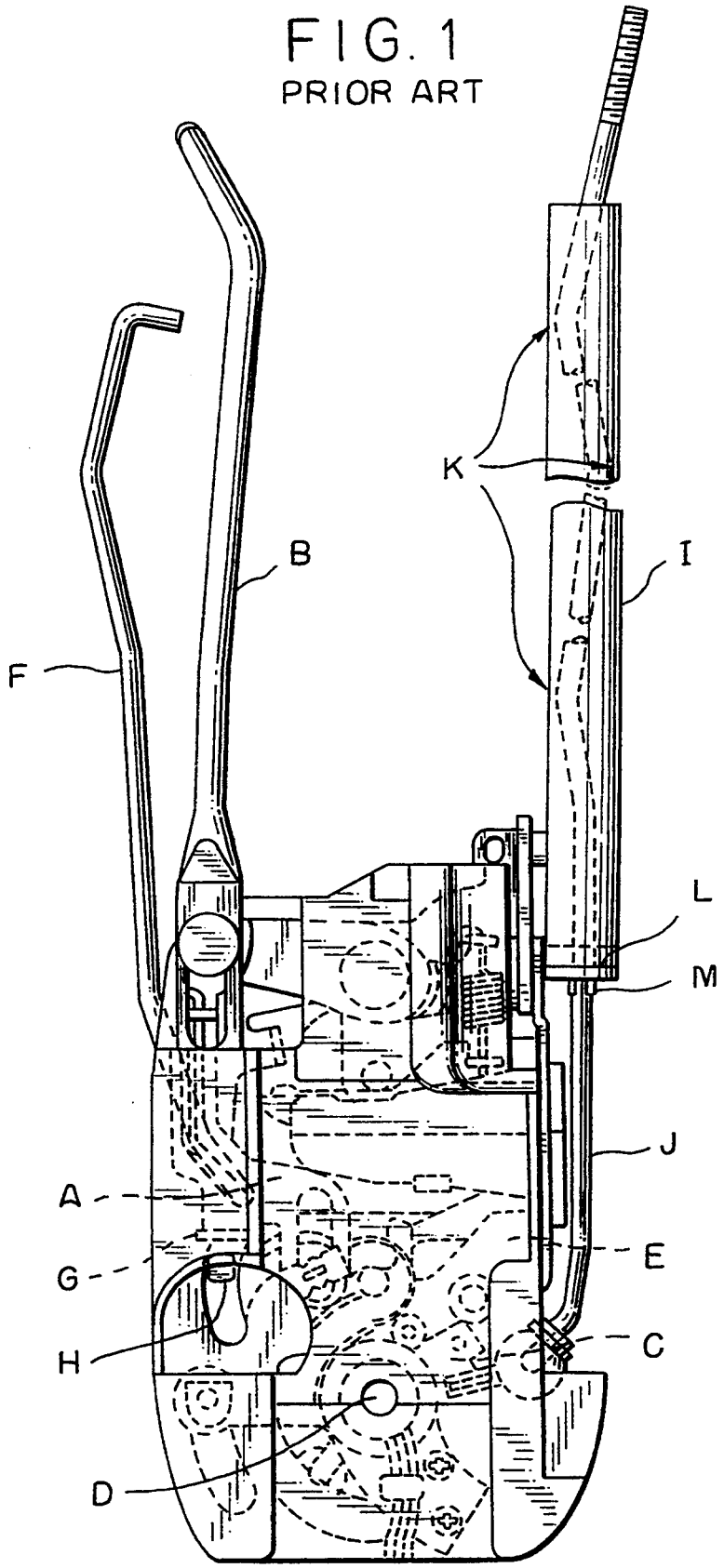
FIG. 1 PRIOR ART
FIG. 1 is a rear elevation of a prior art locking and lacthing mechanism.
Figure 2:
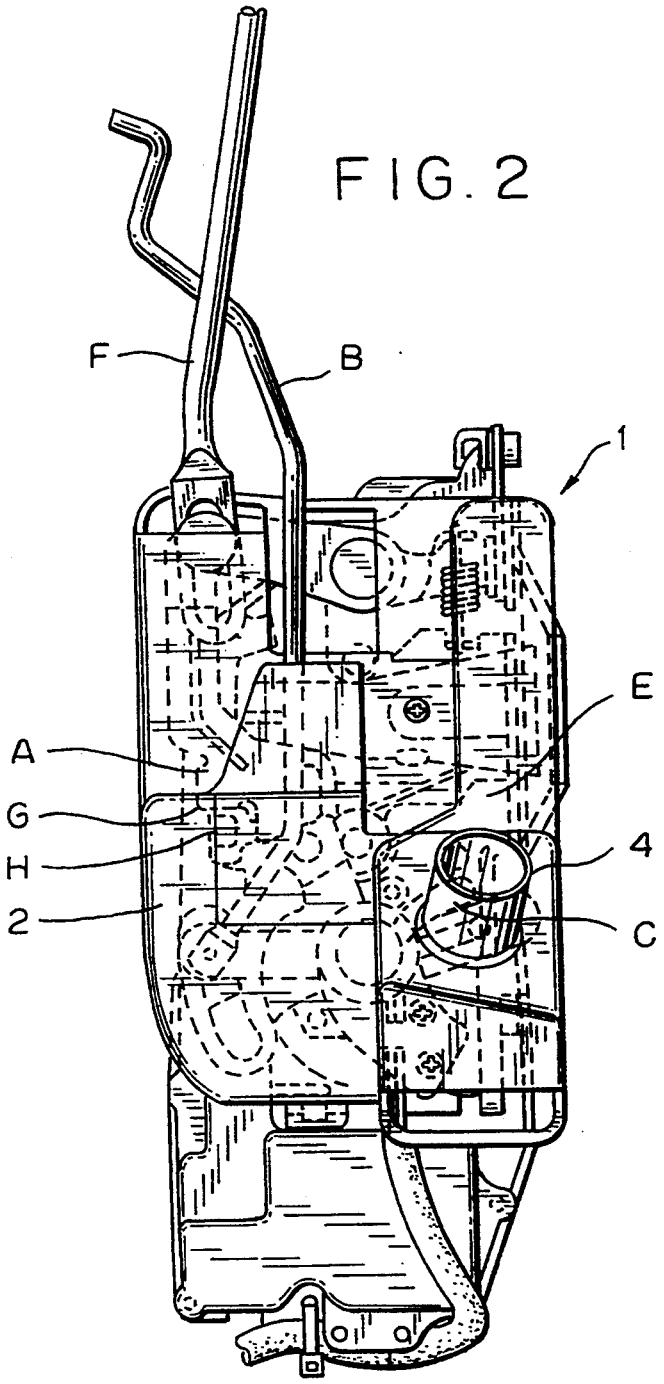
FIG. 2 is a rear elevation of a locking and latching mechanism and anti-theft device of the present invention.

FIG. 2 and 3 show a locking and latching mechanism 1 with a housing 2 covering and protecting various operating components of the locking mechanism 1. The operating components of the locking and latching mechanism 1 are identical to operating components A–H of the prior art locking and latching mechanism shown in FIG. 1 and are not unique to the present invention, and therefore will not be further described in detail. As further shown in FIGS. 2 and 3, a cylindrical anti-theft tube 4 is joined to the locking mechanism housing 2 and extends substantially the full length of and encircles sill knob rod 6. Both housing 2 and tube 4 are preferably molded from a plastic such as polyvinyl chloride (PVC). The anti-theft tube 4 is easily assembled to the housing 2 of the locking mechanism by using a retaining clip or the like as described below in more detail.

Figure 4:
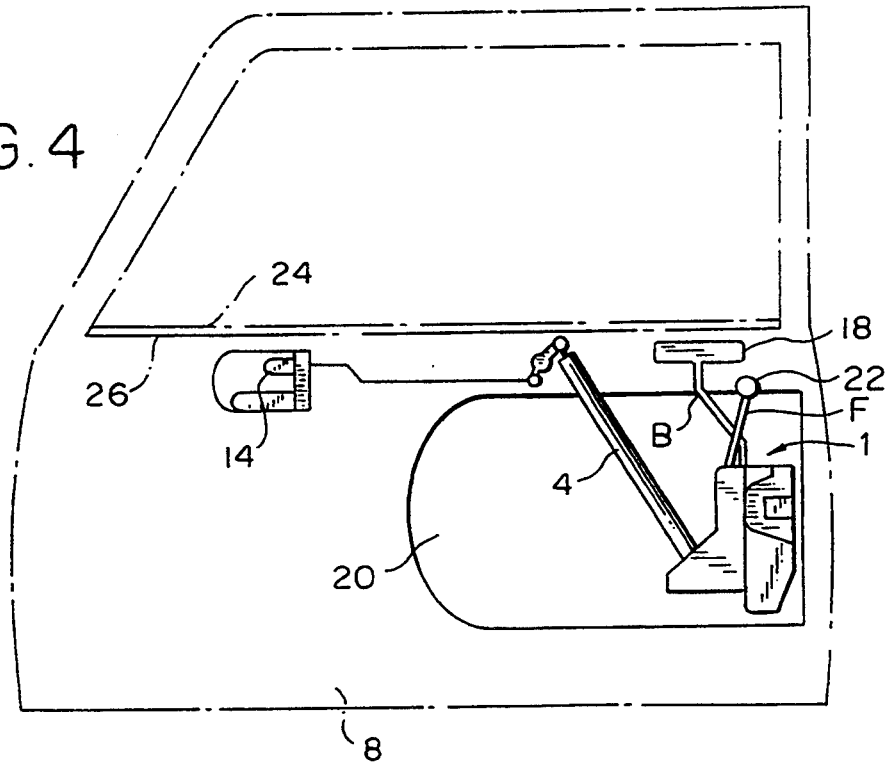
FIG. 4 is a partly schematic side elevation of the locking and latching mechanism and anti-theft device of FIG. 3, shown engaged in a door panel of a vehicle.

FIG. 4 shows locking mechanism 1 installed in the interior of a door panel 8 of a vehicle. Such installation necessitates providing an access to the interior of panel 8 like opening 20 shown in FIG. 4, consistent with conventional practice. Final installation of the locking mechanism 1 with the anti-theft device of the invention results in sill knob rod 6 being engaged to sill knob 14 (sometimes called the "locking knob"), opening rod B engaged to door handle 18 and key rod F engaged to key cylinder 22. As shown in FIG. 4, the sill knob rod 6 maybe connected by a suitable linkage including a horizontally disposed rod to a recessed area within the door into which the locking knob 14 extends from the end of the horizontal rod; or, alternatively, the locking knob 14 may be directly connected to the upper end of the sill knob rod 6 as is more conventional. FIG. 4 illustrates that a gripping tool inserted through gap 24 created at the lower edge of window 26 and the adjacent edge of door panel 8, cannot grip the sill knob rod 6 because such rod 6 is substantially fully enclosed within anti-theft tube 4 joined to housing 2 at all locations along its length which are accessible to a gripping tool, locations above the opening 20 being inaccessible to the gripping tool.

Figure 5:
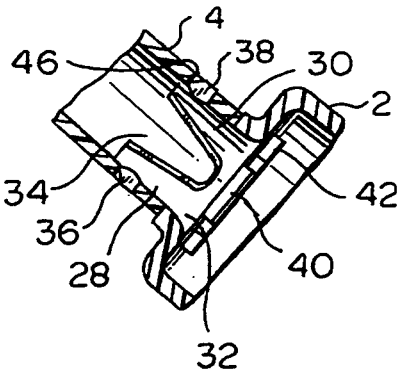
FIG. 5 is a sectional view of one embodiment of the anti-theft tube mounted to the housing of a locking and latching mechanism.
Figure 6:
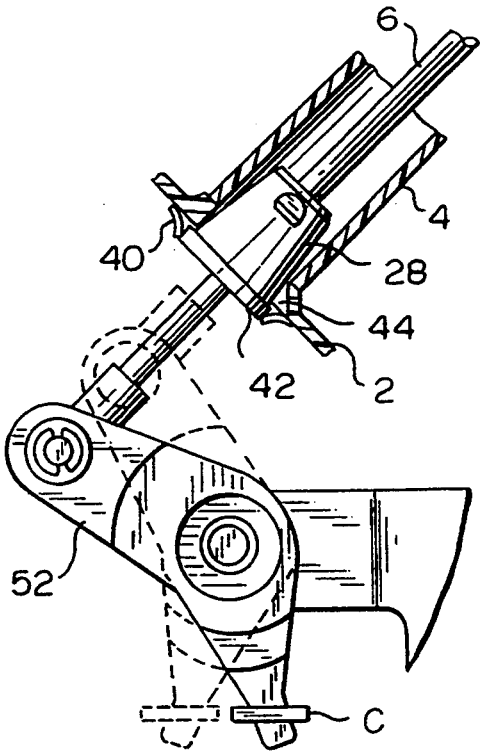
FIG. 6 is a partial cross-section showing the device of FIG. 5 in the locking mechanism.

Cylindrical anti-theft tube 4 can be joined to housing 2 in a number of different ways including being integrally formed in one piece with housing 2. However, the preferred manner of mounting the anti-theft tube 4 to the housing 2 is through use of a retaining clip 28. Retaining clip 28 can be formed from any stiff, resilient material but is preferably molded in one piece from the same material used to make housing 2 and tube 4. As shown in FIGS. 5 and 6, the retaining clip 28 has two opposing portions 30 in part forming a cylindrical segment 32, the opposing portion 30 being separated by V-shaped cut out portions 34. Cylinder segment 32 has an outer diameter substantially equal to the inner diameter of the anti-theft tube 4. Each portion 30 has an outwardly facing detent projection 36 with a slant upper face 38. Two opposing thin resilient wings 40 are integrally formed at the lower end of the cylinder segment 32 slanting upward toward portions 30. As shown in FIG. 5, one or more stop flanges 42 are also integrally formed on the lower end of cylinder segment 32 between the two opposing resilient wings 40.

The anti-theft tube 4 is mounted on housing 2 by inserting the retaining clip 28 through a hole 44 of substantially equal size provided in the housing 2. Hole 44 has diameter substantially equal to the outer diameter of cylinder segment 32 and smaller than the preferably annular flange 42. Portions 30 are then pushed into the tube 4 against the spring action of the wings 40 until stop flanges 42 or annular stop flange 42 halt further movement and detent projections 36, whose upper faces 38 are forced inwardly by the inner wall of the tube 4, snap into and engage holes 46 formed near the bottom end of the tube 4. When the retaining clip 28 is engaged in the tube 4, the resilient wings 40 are resiliently engaged to the inner side of housing 2 along with stop flanges 42. Elastic wings 40 serve to spring bias and to maintain clip 28, tube 4 and housing 2 in close engagement thereby precluding rattling between these elements.

As shown in FIGS. 2 and 3, the housing 2 is mounted about the locking mechanism 1 so that the sill knob rod 6 is coaxial with the longitudinal axis of anti-theft tube 4. This results in the sill knob rod 6 being spaced from the inner wall of the anti-theft tube 4 throughout the length of the rod 6 enclosed within the tube 4. This further helps to eliminate the rattles prevalent in prior art devices. To further eliminate lateral movement of the anti-theft tube 4 when mounted within the door panel, a clip 50 can be fixed to the upper end of tube 4 and then engaged to an inner wall 52 of the door panel 8, as shown in FIG. 3A. The anti-theft tube 4 does not contact the rod 6 and is freely rotatably about its centerline along with engaged clip 28, the tube 4 and the rod 6 being co-axial.

As further shown in FIGS. 3 and 6, the sill knob rod 6 may be rotatably connected to a sub-lever 52 which is rotatably engaged on the locking mechanism 1. Thus, when the sill knob rod 6 is actuated it will rotate the sub-lever 52 to move the locking lever C to either the locked position (as shown in solid lines in FIG. 6) or the unlocked position (shown in dashed lines in FIG. 6) of the locking mechanism 1. It is understood however, that depending on the chosen position of the sill or locking knob within the vehicle, the sill knob rod 6 can be connected to the locking lever C in any number of ways including a direct connection as shown in the prior art device of FIG. 1.

The foregoing description of the specific embodiments will so fully reveal the general nature of the invention that others can, by applying current knowledge, readily modify and/or adapt for various applications such specific embodiments without departing from the generic concept, and, therefore, such adaptations and modifications should and are intended to be comprehended within the meaning and range of equivalents of the disclosed embodiments. It is to be understood that the phraseology or terminology employed herein is for the purpose of description and not of limitation.

We claim:

1. An anti-theft device for use with a vehicle door locking mechanism having a sill knob rod rotatably connected to a locking lever so that actuating the sill knob rod can move the locking lever to either lock or unlock the locking mechanism, said anti-theft device comprising:

a housing to cover and protect the locking mechanism, an anti-theft tube joined at a first end to said housing and having an inner surface, said tube serving to surround the sill knob rod engaged to the locking lever, said first end of said tube engaged to said housing to eliminate a gap between the tube and the housing that would permit access to said sill knob rod, wherein, a periphery of said sill knob rod is spaced away from said inner surface of said tube over the entire length of said sill knob rod enclosed within said tube.

2. The anti-theft device of claim 1, wherein said tube is joined to said housing by clip means for resilient engagement of said housing and said tube.

3. The anti-theft apparatus of claim 1, wherein said tube and said length of said sill knob rod enclosed within said tube are each respectively straight and coaxial.

4. The anti-theft apparatus of claim 1, wherein a second end of said tube is fastened to an interior wall of a door panel of a vehicle.

5. The anti-theft apparatus of claim 1, wherein said tube has a circular cross-section.

6. In a locking mechanism for a vehicle door comprising a sill knob rod rotatably connected to a locking lever so that said sill knob rod can be actuated by a locking knob to move said locking lever to either lock or unlock said locking mechanism, and an anti-theft tube surrounding said sill knob rod, the improvement comprising:

a housing to cover and protect said locking mechanism, and wherein said sill knob rod is substantially straight with said anti-theft tube surrounding said sill knob rod in non-contact relationship therewith along substantially the entire length of said sill knob rod enclosed within said tube.

7. A locking mechanism according to claim 6 wherein said anti-theft tube is connected to said housing by clip means for resiliently engaging said anti-theft tube to said housing.

8. A locking mechanism in accordance with claim 6 wherein said tube is substantially straight and is coaxial with said sill knob rod.

9. A locking mechanism according to claim 6 further comprising fastening means for fastening an end of said anti-theft tube distal from said housing to an interior wall of a door panel of a vehicle.

10. A locking mechanism in accordance with claim 6 wherein said anti-theft tube has a circular cross-section.

11. An anti-theft device for installation within a vehicle door in conjunction with a vehicle door locking mechanism having a sill knob rod rotatably connected to a locking lever so that actuating the sill knob rod causes movement of the locking lever to either a locked or unlocked position for the locking mechanism, said anti-theft device comprising:

a hollow elongated straight plastic tube for encircling the sill knob rod in a spaced apart relationship thereto; and clip means for connecting a lower end of said tube to a housing for the locking mechanism, said clip means comprising resilient biasing means for holding said tube and the housing together in such a way as to prevent rattling and eliminate gaps that would permit access to the sill knob rod.

12. An improved anti-theft device in accordance with claim 11 wherein said clip means comprises a clip which comprises a bottom end having a flange which is adapted to engage an inner wall of the locking mechanism housing, and an upper portion having snap-fit projections for extending within the bottom end of said tube with said snap-fit projections extending through openings in said tube.

* * * * *